US005194905A

United States Patent [19]

Brewington

[11] Patent Number: 5,194,905

[45] Date of Patent: Mar. 16, 1993

[54] COLOR PRINTER APPARATUS FOR PRINTING SELECTED PORTIONS OF LATENT IMAGES IN VARIOUS COLORS

[75] Inventor: Grace T. Brewington, Fairport, N.Y.

[73] Assignee: Xerox Corporation, Stamford, Conn.

[21] Appl. No.: 619,649

[22] Filed: Nov. 29, 1990

[51] Int. Cl.[5] ..... G03G 15/01

[52] U.S. Cl. ..... 355/326; 355/208; 430/42

[58] Field of Search ..... 355/326, 327, 328, 208; 430/42, 120

[56] References Cited

U.S. PATENT DOCUMENTS

| | | | |
|---|---|---|---|
| 3,709,593 | 1/1973 | Matsumoto et al. | 355/326 |
| 3,914,043 | 10/1975 | McVeigh | 355/326 |
| 4,459,009 | 7/1984 | Hays et al. . | |
| 4,710,016 | 12/1987 | Waatanabe . | |
| 4,721,978 | 1/1988 | Herley | 355/328 |
| 4,742,373 | 5/1988 | Nakatani . | |
| 4,752,802 | 6/1988 | Ito et al. . | |
| 4,754,301 | 6/1988 | Kasamura et al. . | |
| 4,811,046 | 3/1989 | May . | |
| 4,913,348 | 4/1990 | Hays | 355/328 X |
| 4,937,636 | 6/1990 | Rees et al. | 355/328 |
| 4,984,020 | 1/1991 | Adachi et al. | 355/328 X |
| 5,012,299 | 4/1991 | Sawamura et al. | 355/326 |

FOREIGN PATENT DOCUMENTS

| | | | |
|---|---|---|---|
| 61-167960 | 7/1986 | Japan | 355/326 |
| 2-20884 | 1/1990 | Japan | 355/327 |
| 2-40667 | 2/1990 | Japan | 355/327 |

*Primary Examiner*—A. T. Grimley
*Assistant Examiner*—Shuk Y. Lee

[57] ABSTRACT

Color image creation wherein the color is user selectable selection of a desired color establishes the duty cycle of each of a plurality of developer structures which, in turn, determines how much, if any, of each color toner is deposited on a particular image. The duty cycle of each developer structure may vary between zero and a predetermined maximum time which corresponds to the time it takes for an image area on a charge retentive surface to move through a development nip intermediate the charge retentive surface and one of the developer structures.

2 Claims, 3 Drawing Sheets

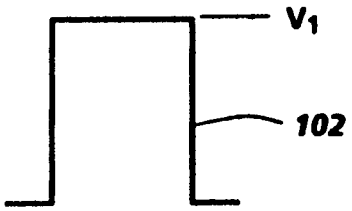
FIG. 3a
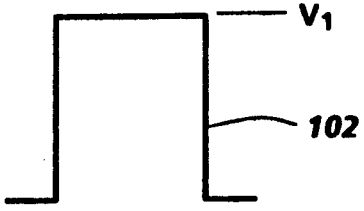
FIG. 3b
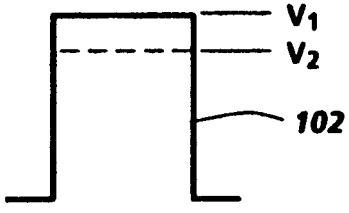
FIG. 3c
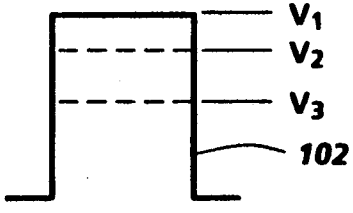
FIG. 3d
FIG. 3e
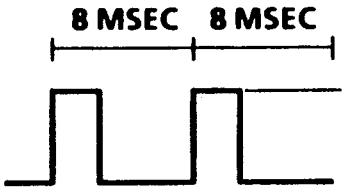
FIG. 3f
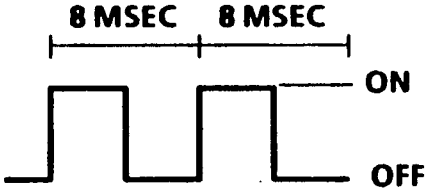
FIG. 3g

COLOR PRINTER APPARATUS FOR PRINTING SELECTED PORTIONS OF LATENT IMAGES IN VARIOUS COLORS

BACKGROUND OF THE INVENTION

This invention relates generally to highlight color imaging and more particularly to user selection of image colors.

It is common practice to add information to the face of a document or to highlight certain portions of it by underlining. It is also common to delete portions of the document either by crossing out information or by covering it with a blank piece of paper. As will be appreciated, writing data or underlining on the document spoils the original document while writing data or underlining on the copies requires much labor when many copies are required. Moreover, it is sometimes difficult to write on copies due to the impregnation of the paper substrate with silicone oil used in the fusing of the images to the substrate. Recent developments in imaging systems have obviated the foregoing problems by the provision of methods and apparatus to reproduce an altered copy of the original document, as well as an identical copy thereof. Thus, recent innovations in printing machines provide for reproducing a document without unwanted information of the original document, and with the addition of new data thereto. In this way, the machine performs an editing function which significantly reduces the labor and time in preparing revised copies from the original document. Another editing function relates to highlighting an area of a document to be copied or printed in a color different from the rest of the document.

The latent image of an original document, formed by scanning the original document and projecting a light image thereof onto the charged portion of the photoconductive surface so as to selectively discharge the charge thereon, may be altered in various ways. The latent image may be edited by superimposing thereover an electrically modulated beam, such as a modulated laser beam, or the like. The modulated laser beam adds additional information or erases information from the scanned latent image. In this way, the resultant copy is altered from the original document. Various techniques have been devised for transmitting an electrical signal to modulate the laser so that the desired information is recorded on the latent image. The latent image may also be altered by selective actuation of light emitting diodes which are positioned perpendicular to the process direction of the printing machine.

The Panasonic E2S copier system uses an electronic pad to edit, move or delete information on a copy, and the Panasonic electronic print board allows information recorded on a blackboard sized electronic board to be copied automatically by a copying machine on a copy sheet. In order to define the area that is to be altered, the coordinates of the relevant information on the original document to be modified must be transmitted to the printing machine.

The NP 3525 and Color Laser Copier manufactured by the Canon Corporation employs an edit pad which enables selected portions of a copy to be deleted. The NP 3525 and Color Laser Copier edit pad also permits color highlighting of designated areas of the document.

The formation of image areas to be highlighted is disclosed in U.S. Pat. No. 4,742,373. Highlighting in accordance with the disclosure of this patent is effected by using an editing pad to designate x, y coordinate values of information to be highlighted. The output from the editing pad is utilized to vary the intensity of a bank of light emitting diodes (LEDS) positioned perpendicular to the process direction of a charge retentive surface. Thus, for highlighting certain information of the original document, the LEDS are operated at half intensity. While the disclosure of this patent appears to be silent as to the actual method of developing such an image, it is customary to use a plurality of developer housings containing different color developers for this purpose.

U.S. Pat. Nos. 4,710,016 and 4,754,301 disclose an imaging apparatus which utilizes two colored developer housings which are adapted to be selectively moved between development and non-development positions relative to the charge retentive surface.

U.S. Pat. No. 4,752,802 illustrates a magnetic brush development system designed so that toner or developer can be withdrawn from the development zone without having to move the developer housing away from the charge retentive surface as required in the '301 patent. Two developer units are employed and are selectively used for each copying operation by the operator manipulating a selector switch provided on a control panel. At least one developing unit of the two component magnetic brush type is disposed opposite an electrostatic latent image receiver. The developing units have a developing sleeve in which is housed a magnetic core assembly that can be oriented by a drive means to switch development on and off by controlling the height of the developer in the development zone and the amount of developer metered onto the roll. The rotatable developing sleeve is turned on and off simultaneously with the magnet orientation to switch development on and off, respectively. For development, the magnetic core assembly is so rotated that a weak magnetic or non-magnetic portion is at a position opposite to a level regulating member, and a high magnetic field is at a position opposite to the electrostatic latent image carrier. Furthermore, the rotating sleeve is stopped when development is switched off. Thus, to switch off development a developing powder present on the outer periphery of the developing sleeve is shunted away from the developing zone and the sleeve rotation stopped. Such shunting of the developing powder is carried out with any of the developing units other than one selected for developing. Since development is obtained with a strong magnetic field in a zone adjacent to the electrostatic latent image carrier, the transitional width for switching color development is 8 mm.

U.S. Pat. No. 4,811,046 discloses a tri-level image development system comprising two developer housings, each containing at least two magnetic brush developer rolls. The developer rolls in one of the housings are adapted to be reverse rotated for the purpose of removing toner material from the development zone formed by the two rolls and a charge retentive surface.

U.S. Pat. No. 4,913,348 discloses an imaging system wherein an electrostatic charge pattern comprising charged image areas and discharged background are formed on a charge retentive surface. The fully charged image areas are at a voltage level of approximately −500 volts and the background is at a voltage level of approximately −100 volts. A spatial portion of the image area is used to form a first image with a narrow development zone while other spatial portions are used to form other images which are distinct from the first image in some physical property such as color or magnetic state. The development is rapidly turned on and off by a combination of AC and DC electrical switching. Thus, high spatial resolution multi-color development in the process direction can be obtained in a single pass of the charge retentive surface through the processing stations of a copying or printing apparatus. Also, since the voltages representing all images are at the same voltage polarity unipolar toner can be employed. In order to effect development of all images with a unipolar toner, each of the development system structures is capable of selective actuation without physical movement.

BRIEF DESCRIPTION OF THE DRAWINGS

FIGS. 3*a* through 3*d* show a bi-level image which has moved through cyan, magenta and yellow developer housings and FIGS. 3*e* through 3*g* show the operating conditions of the three developer housings as the bi-level image of FIGS. 3*a* through 3*d* passes therethrough.

BRIEF SUMMARY OF THE INVENTION

Briefly, in accordance with the present invention, at least four developer housings maybe provided containing black, cyan, magenta and yellow toners. The four housings are adapted to apply varying amounts of toner to a particular image. To this end, the duty cycle of each developer housing is variable. Any one of the developer housings may be turned off as an image passes thereby or it may be turned on for various time durations to thereby apply more or less of a particular toner to the image being developed. Thus, an image may have none of a particular toner applied thereto or it may have a particular toner applied thereto in varying amounts depending on the duty cycle of the developer housings.

In accordance with the invention, a tri-level image (i.e., one having a discharged-area image, a charged-area image and a background area) could be developed by applying only black toner to one of the image areas and by applying one or more toners, in varying amounts, to the other image area to produce a highlight color image. Alternatively, a bi-level image (i.e. an image containing a charged area and a discharge area) can be developed by applying thereto one or more of the available toners in varying amounts. The toners may be applied either to the charged area or the discharged area. The area not developed represents the background.

A plurality of images of different colors can be created on the same image receiver. A particular image may comprise a highlight color image or it may represent a particular logo.

The particular color to be applied to an image is user selectable. A document to be copied is placed on an editing pad where one or more portions thereof may be delineated in a well know manner. The user then selects a desired color from a palette of colors. The selected area and color information are supplied to the Input-/Output Terminal (IOT) through a User Interface and an Electronic Sub-System (ESS), where computer logic and algorithms determine the operating state of each of the developer housings. The appropriate developer housings are actuated through signals supplied thereto through a suitable relay interface between the ESS and the developer housings.

DETAILED DESCRIPTION OF THE PREFERRED EMBODIMENT OF THE INVENTION

This invention relates to an imaging system which is used to produce a color output in a single pass. It will be understood that it is not intended to limit the invention to the embodiment disclosed. On the contrary, it is intended to cover all alternatives, modifications and equivalents as may be included within the spirit and scope of the invention as defined by the appended claims.

Figure 1:
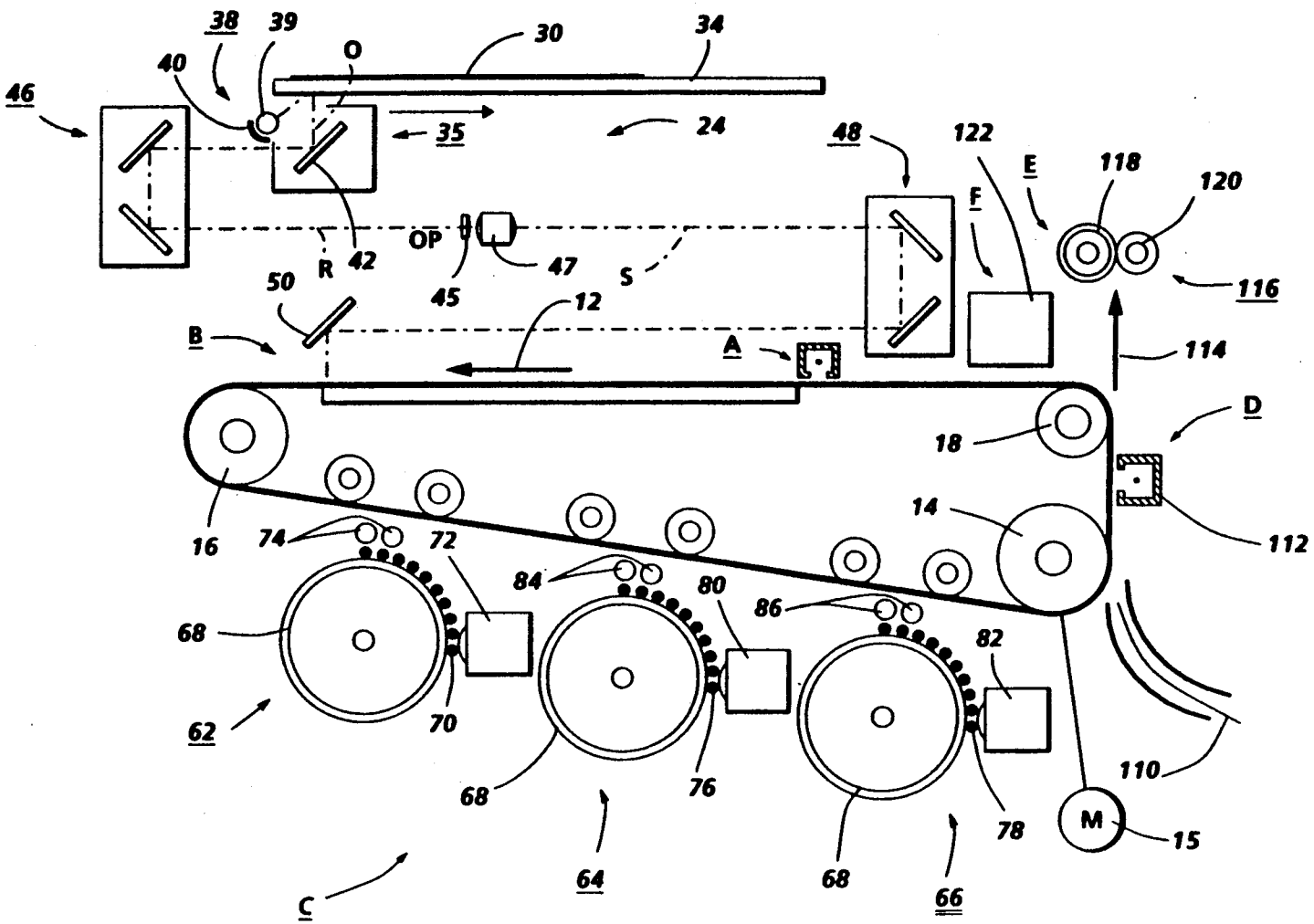
FIG. 1 is schematic illustration of an imaging apparatus incorporating the development system features of the invention.

Turning now to FIG. 1, the electrophotographic printing machine uses a monopolar photoreceptor belt 10 having a photoconductive surface formed on a conductive substrate. Belt 10 moves in the direction indicated by arrow 12, advancing sequentially through the various xerographic process stations. The belt is entrained about a drive roller 14 and two tension rollers 16 and 18 and is operatively connected to a drive motor 15.

With continued reference to FIG. 1, a portion of belt 10 passes through charging station A where a corona generating device, indicated generally by the reference numeral 22, charges the photoconductive surface of belt 10 to a relative high, substantially uniform, negative potential.

Next, the charged portion of photoconductive surface is advanced through an imaging station B. The imaging station includes an exposure system, indicated generally by the reference numeral 24. An original document 30 is positioned face down on a transparent platen 34. The original document 30 may comprise a sheet of white paper having black images thereon. Alternatively, the document 30 may contain black, informational text areas, white background areas and a second informational area formed by applying a red fluorescent pigment through a stencil as disclosed in U.S. Pat. No. 4,937,636.

The exposure system comprises an optics assembly 35 including optical components which incrementally scan-illuminate the document 30 from left to right and project a reflected image onto the photoconductive surface of belt 10, forming a latent image of the document thereon. Shown schematically, these optical components comprise an illumination lamp assembly 38, comprising an elongated fluorescent lamp 39 and associated reflector 40. Assembly 38 and full rate scan mirror 42 are mounted on a scan carriage (not shown) adapted to travel along a path parallel to and beneath the platen 34. Lamp 39, in conjunction with reflector 40, illuminates an incremental line portion of document 30. The reflected image is reflected by scan mirror 42 to corner mirror assembly 46 which is adapted to move at the same rate as the carriage mirror 42. The document image is projected along optical path OP and then through lens 47. The image is then reflected by a second corner mirror assembly 48 and by belt mirror 50, onto the photoconductive surface of belt 10 to form thereon a bi-level electrostatic latent image corresponding to the information areas contained within original document 30. The bi-level image, as disclosed, comprises a charged image area and a discharged background area but may comprise a discharged image area and charged background area.

At development station C, a development system, indicated generally by the reference numeral 60, advances developer materials into development zones. The development system 60 comprises three scavengeless development systems 62, 64 and 66. By scavengeless is meant that the developer or toner must not interact with an image already formed on the image receiver. Thus, the developer systems are also known as non-interactive development systems. The development system 62 comprises a donor structure in the form of a roller 68. The donor structure 68 conveys a toner layer to the development zone or nip (i.e. area between the member 10 and the donor structure 68. The toner layer can be formed on the donor 68 by either a two component developer (i.e. toner and carrier) or a single component developer comprising toner 70 deposited on member 68 via a combination single component toner metering and charging device 72. The development zone contains an AC biased electrode structure 74 self-spaced from the donor roll 68 by the toner layer 70. The single component toner 70 may positively charged cyan toner. The donor roller 68 may be coated with TEFLON-S (trademark of E.I. DuPont De Nemours) loaded with carbon black.

For single component toner, the combination metering and charging device 72 may comprise any suitable device for depositing a monolayer of well charged toner onto the donor structure 68. For example, it may comprise an apparatus such as described in U.S. Pat. No. 4,459,009 wherein the contact between weakly charged toner particles and a triboelectrically active coating contained on a charging roller results in well charged toner. Other combination metering and charging devices may be employed. For donor roll loading with two component developer, a conventional magnetic brush can be used for depositing the toner layer onto the donor structure.

The electrode structure 74 comprises one or more thin (i.e. 50 to 100μ diameter) tungsten or stainless steel wires which are lightly positioned against the toner 70 on the donor structure 68. The distance between the wires and the donor is self-spaced by the thickness of the toner layer which is approximately 25μ. The extremities of the wires are supported by end blocks (not shown) at points slightly below a tangent to the donor roll surface. Mounting the wires in such manner makes the self-spacing insensitive to roll runout.

Figure 2:
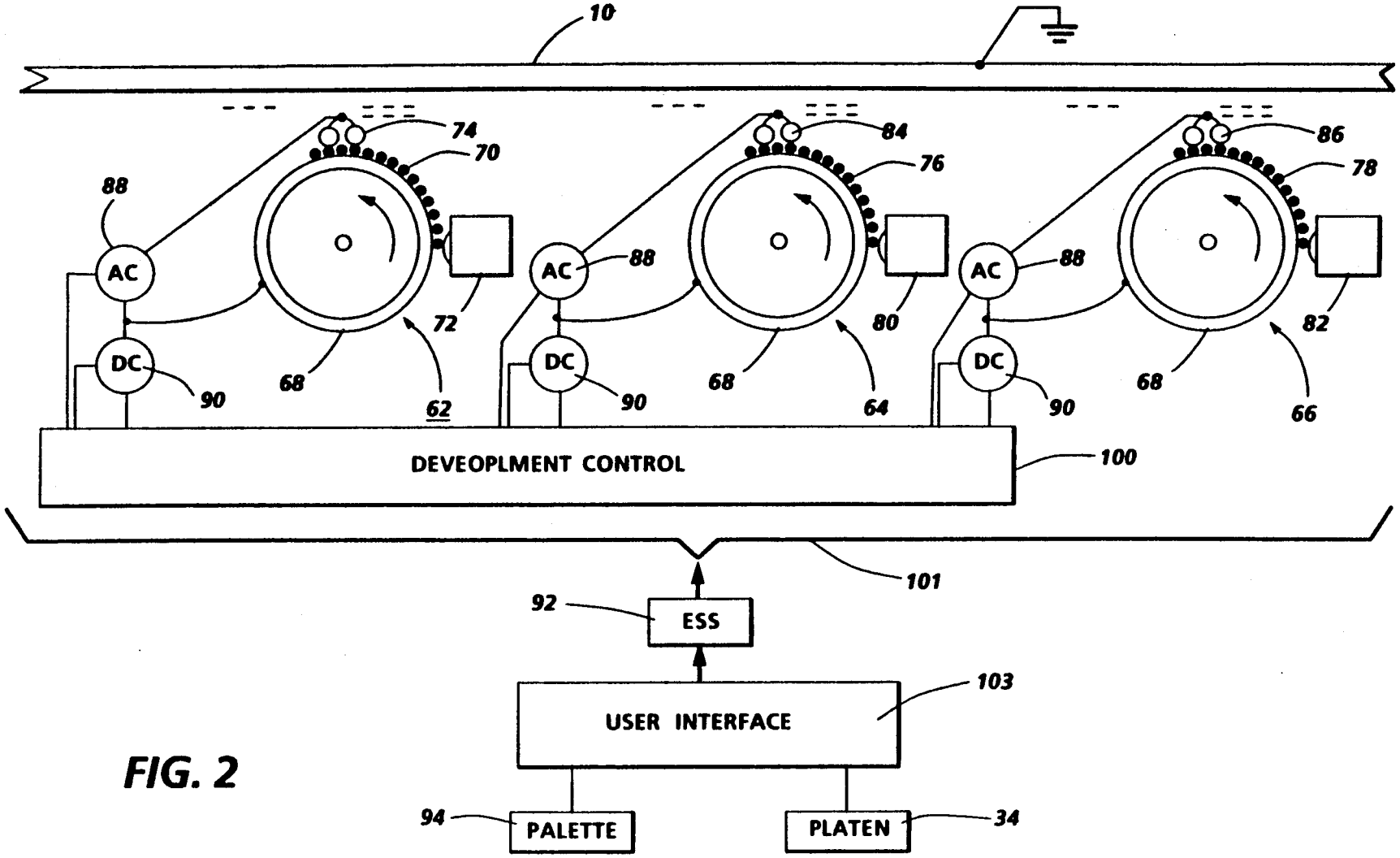
FIG. 2 is a schematic illustration of an imaging apparatus incorporating the inventive features of the invention.

The developer apparatuses of systems 64 and 66 are similar to the developer apparatus 62, like elements thereof being referenced by the same reference characters. FIG. 2 shows the donor structures 68 conveying single component toner 76 and 78 deposited thereon via a combination metering and charging devices 80 and 82 to an electrode structures 84 and 86 in second and third development zones or nips. The single component toner 76 in this example comprises positively charged magenta while the toner 78 comprises a positively charged yellow toner. The donor structures can be rotated in either the 'with' or 'against' direction vis-a-vis the direction of motion of the charge retentive surface. The toners 76 and 78 may be provided from two component developers.

As illustrated in FIG. 2, an alternating electrical bias is applied to the electrode structure 74 via a square wave AC voltage source 88. The applied AC establishes an alternating electrostatic field between the wires and the donor structure which is effective in detaching toner from the surface of the donor structure and forming a toner cloud about the wires, the height of the cloud being such as not to contact the charge retentive surface 10. The magnitude of the AC voltage is relatively low and is in the order of 250 to 400 volts peak at a frequency of about 4 kHz up to 10 kHz. A DC bias supply 90 applies a voltage to the donor structure 68 which establishes an electrostatic field between the charge retentive surface of the photoreceptor 10 and the donor structure for the purpose of suppressing toner deposition in the discharged area latent image on the charge retentive surface. A DC bias of approximately −200 volts is used for the development of charged area images with positively charged cyan toner. It is to be understood here that the image receiver is initially charged to a potential of about −900 volts with full discharge to about −100 volts.

As further illustrated in FIG. 2, a similar alternating electrical bias is applied to the electrode structure 76 associated with the developer system 64 via a square wave AC voltage source 88. The applied AC establishes an alternating electrostatic field between the wires 84 and the donor structure which is effective in detaching toner from the surface of the donor structure and forming a toner cloud about the wires, the height of the cloud being such as not to contact the charge retentive surface. The magnitude of the AC voltage is relatively low and is in the order of 250 to 400 volts peak at a frequency of about 4 kHz up to 10 kHz. A DC bias supply 90 applies a voltage to the donor structure 68 of developer apparatus 64 which establishes an electrostatic field between the charge retentive surface of the photoreceptor 10 and the donor structure for the purpose of suppressing toner deposition in the discharged areas on the charge retentive surface. A dc bias of approximately −200 volts is used for applying positively charged magenta toner to the charged areas of the bi-level image.

Biases similar to those applied in the case of the developer system 64 are applied to the electrodes 86 and donor 68 of the developer system 66 for effecting deposition of positively charged yellow toner on charged areas.

Under the control of an Electronic Sub-System (ESS) 92 the developer systems 62, 64 and 66 are timely actuated, each for a duty cycle determined by the color selected by the user from a color palette 94 forming part of a machine control panel 96. The duty cycle may vary from 0 to 8 msec in accordance with the color to created from the three developer structures. A development control unit 100 provides operative connections between the ESS and the power supplies 88 and 90.

The zero duty cycle corresponds to the "OFF" state of the developer structure. In this state the AC supplied to the wires or electrodes 74, 84 or 86 is shut off and strong cleaning potential of approximately minus 500 volts is applied to the donor roll structure to prevent deposition of toner mechanically dislodged by the wire electrodes. For a development nip width of 1 mm and a process speed of 125 mm per second, the time for a segment of image to traverse the development nip is 8 msec.

The components delimited by a bracket 101 form part of an input/output terminal (IOT).

Illustrated in FIGS. 3*a* through 3*d* is a bi-level image 102 at successive stages of development as it passes through the developer structures 62, 64 and 66. As depicted in FIG. 3*a*, the bi-level image comprises a charged image area at voltage level $V_1$. After passing through the cyan developer structure 62 which is in an "off" state as indicated in FIG. 3*e*, the fully charge image at voltage level $V_1$ (FIG. 3*b*) is still at that voltage level because no cyan toner is deposited thereon. As depicted in FIG. 3*c*, the latent image 102, after passage through the magenta developer structure 64, has been discharged to a voltage level $V_2$ due to the deposition of magenta toner thereon. The amount of magenta toner deposited is determined by the duty cycle of this developer structure which, in turn, is determined by which of the color buttons of the color palette has been selected by the operator. In this example, as shown in FIG. 3*f*, the duty cycle is about 30%. Thus, the magenta developer structure is operated for approximately 2.4 msec of the maximum 8.0 msec duty cycle. This results in the image 102 being further discharged to voltage level $V_2$. The amount of yellow toner deposited is determined by the duty cycle of the yellow developer structure which, in turn, is determined by which of the color buttons of the color palette has been selected by the operator. In this example, as shown in FIG. 3*g*, the duty cycle is about 50%. Thus, the magenta developer structure is operated for approximately 4.0 msec of the maximum 8.0 msec duty cycle. Development of the image with yellow developer results in the image being discharged to a final voltage level, $V_3$. The resulting image has an orange to red color.

As will be appreciated, the selection of a different color button from the palette 94 will yield another color.

The ESS 26 is operatively coupled to the IOT to provide, among other things, electrical signals to the power supplies when certain images are present in one of development zones 74, 76 and 78. The ESS comprises computer, process control members and logic circuitry based on conventional, well known technology.

The palette 94 and platen 34 form part of a user interface 103.

In the case of the development systems 64 and 66, to rapidly switch on development with the donor roll structure rotating, the AC is applied with 200 to 400 volts peak and the DC is set at a level to effect discharged area development and control background deposition with the minimum electric field. To rapidly switch off development, the AC is turned off and the DC may be set at a level which suppresses toner deposition on the charge retentive surface. A DC level shift is desirable since mechanical disturbance of the toner layer by the self-spaced wire structures can cause some toner deposition in the image areas unless the DC electric field is in the sense to prevent the dislodged toner from depositing in the image areas. For a single AC biased 50$\mu$ wire structure, the transition distance between on and off for one color can be as narrow as 0.5 mm. For two AC biased wire structures, the transition distance is increased by the distance between the two wires, unless the wires are separately biased and separately addressable, in which case no increase in transition distance would be necessary.

Referring again to FIG. 1, a sheet of support material 110 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. The feed roll rotates so as to advance the uppermost sheet from stack into a chute which directs the advancing sheet of support material into contact with photoconductive surface of belt 10 in a timed sequence so that the composite toner powder image developed thereon contacts the advancing sheet of support material at transfer station D.

Transfer station D includes a corona generating device 112 which sprays ions of a suitable polarity onto the backside of sheet 110. This attracts the charged toner powder images from the belt 10 to sheet 110. After transfer, the sheet continues to move, in the direction of arrow 114, onto a conveyor (not shown) which advances the sheet to fusing station E.

Fusing station E includes a fuser assembly, indicated generally by the reference numeral 116, which permanently affixes the transferred powder image to sheet 110. Preferably, fuser assembly 116 comprises a heated fuser roller 118 and a backup roller 120. Sheet 110 passes between fuser roller 118 and a backup roller 120 with the toner powder image contacting fuser roller 118. In this manner, a toner powder image is permanently affixed to sheet 110. After fusing, a chute, not shown, guides the advancing sheet 110 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing 122 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

While the present invention is disclosed in an electronic reprographics device, the invention could be used in other devices such as printers.

What is claimed is:

1. Apparatus for creating color images in a single pass of a charge retentive surface past a plurality of process stations, said apparatus comprising:

a charge retentive surface;

means for forming latent electrostatic images on said charge retentive surface;

a plurality of developer structures, each containing a different color toner for selective toner deposition on said latent electrostatic images, each of said developer structures being positioned in a development nip between it and said charge retentive surface;

means for electrically biasing each of said developer structures for a period of time;

means for selectively modifying said period of time for each developer structure whereby the quantity of toner deposited on said latent electrostatic images by each developer structure can be varied;

said means for selectively modifying said period of time being capable of modifying it from a time of zero to a maximum time, said maximum time corresponding to the time for an image on said charge retentive surface to move through a development nip; and said means for selectively modifying comprising a user selectable color palette.

2. A method for creating color images in a single pass of a charge retentive surface past a plurality of process stations, said method comprising:

moving a charge retentive surface in a predetermined path;

forming latent electrostatic images on said charge retentive surface;

positioning a plurality of developer structures adjacent said charge retentive surface thereby forming a development nip between each developer structure and said charge retentive surface;

electrically biasing each of said developer structures for a period time;

providing means for selectively modifying said period of time for each developer structure whereby the quantity of toner delivered by each developer structure can be varied;

said step of selectively modifying said period of time being capable of modifying it from a time of zero to a maximum time, said maximum time corresponding to the time for an image on said charge retentive surface to move through a development nip; and said step of selectively modifying comprising using a user selectable color palette.

* * * * *